US012077839B1

(12) United States Patent
Cheung et al.

(10) Patent No.: US 12,077,839 B1
(45) Date of Patent: Sep. 3, 2024

(54) ALLOY WITH INTERFERENCE THIN FILM AND METHOD FOR MAKING THE SAME

(71) Applicant: Chow Sang Sang Jewellery Company Limited, Hong Kong (CN)

(72) Inventors: Wai Kei Cheung, Hong Kong (CN); Shuk Kwan Mak, Hong Kong (CN); Candice Wing Jong Tong, Hong Kong (CN)

(73) Assignee: CHOW SANG SANG JEWELLERY COMPANY LIMITED, Hong Kong (CN)

( * ) Notice: Subject to any disclaimer, the term of this patent is extended or adjusted under 35 U.S.C. 154(b) by 0 days.

(21) Appl. No.: 18/239,747

(22) Filed: Aug. 29, 2023

(30) Foreign Application Priority Data

Jul. 26, 2023 (HK) ..... 32023076637.2

(51) Int. Cl.

| | |
|---|---|
| ***C22C 5/02*** | (2006.01) |
| ***C22C 1/02*** | (2006.01) |
| ***C22F 1/02*** | (2006.01) |
| ***C22F 1/14*** | (2006.01) |
| ***C23F 1/00*** | (2006.01) |

(52) U.S. Cl.
CPC ..... *C22C 5/02* (2013.01); *C22C 1/02* (2013.01); *C22F 1/02* (2013.01); *C22F 1/14* (2013.01); *C23F 1/00* (2013.01)

(58) Field of Classification Search
CPC ..... C22C 5/02; C22C 1/02; C22F 1/02; C22F 1/14; C23F 1/00
See application file for complete search history.

(56) References Cited

U.S. PATENT DOCUMENTS 5,059,255 A 10/1991 Muller

FOREIGN PATENT DOCUMENTS

| | | | | | |
|---|---|---|---|---|---|
| CN | 101255508 | A | * | 9/2008 | |
| CN | 101255508 | A | | 9/2008 | |
| CN | 107604330 | A | | 1/2018 | |
| CN | 110468298 | A | | 11/2019 | |
| CN | 111187940 | A | * | 5/2020 | ..... B21F 3/02 |
| CN | 111187940 | A | | 5/2020 | |
| CN | 115044798 | A | | 9/2022 | |
| EP | 0438980 | A1 | | 2/1990 | |
| JP | 2185934 | A | | 7/1990 | |
| JP | 2002363772 | A | * | 12/2002 | |
| JP | 2002363772 | A | | 12/2002 | |

OTHER PUBLICATIONS

Corti, C., (2019) "Jewellery Alloys—Past, Present and Future". The Goldsmiths' Company Jewellery Materials Congress.

(Continued)

*Primary Examiner* — Anthony M Liang
*Assistant Examiner* — Danny N Kang
(74) *Attorney, Agent, or Firm* — Law Offices of Albert Wai-Kit Chan, PLLC

(57) ABSTRACT

This invention provides an alloy with an interference thin film and the method for making the same. In one embodiment, said alloy consists essentially of 55.0-78.0 wt % Au, 8.0-24.0 wt % Ag, 8.0-24.0 wt % Cu and 0.0-3.0 wt % deoxidizer, and said interference thin film is grown on a surface of said alloy and has a thickness of less than 200 nm; wherein said interference thin film exhibits a patination color.

20 Claims, 4 Drawing Sheets

(56) References Cited

OTHER PUBLICATIONS

Corti, C., (2016) "Special Colors of Precious-Metal Jewelry Present and Future". Santa Fe Symposium.
Cretu, C. et al. "Coloured Gold Alloys". Gold Bulletin 1999, 32(4) 115.
Corti, C., (2004) "Blue, black and purple: The special colours of gold". Santa Fe Symposium.

* cited by examiner

ALLOY WITH INTERFERENCE THIN FILM AND METHOD FOR MAKING THE SAME

FIELD OF THE INVENTION

The present invention relates to the patination color on gold alloys.

BACKGROUND OF THE INVENTION

For jewelry manufacturing, different colors of precious metals may be incorporated to create an aesthetic and desirable product. Traditionally, gold alloys come in various shades of colors, commonly yellow, white, and rose. The different color shades can be formed by varying the silver-copper ratio within the gold-silver-copper alloy composition. The implementation of surface treatment methods, for example electrodeposition and patination methods, have also shown to be able to present some new colors to the gold alloys.

Patination is a method of forming a thin colored layer on metal surfaces, usually bronze and copper, as a result of oxidation. Copper and bronze patinas, natural or artificial, usually display a blue-green coloration. Patination is sometimes used as a method to provide a protective coating to the metal, but in the jewelry industry, it is more often a technique used to create a coloration to jewelry alloys. The color of patinated metal alloy surface is dependent on the composition of the metal alloy and also the heat treatment method. For example, jewelry alloy containing chromium may show a red color upon heat-treatment due to formation of Cr(VI) oxide, while the presence of iron may show a green color after heat treatment due to formation of iron (II) oxide.

European Pat. EP0438980 described the formation of a black cobalt oxide layer on cobalt-containing gold alloys (Au—Ag—Cu—Co) by heat treatment at 400° C. to 1100° C. for 15 minutes to one hour. However, a problem with cobalt is that it is very prone to oxidation. The use of cobalt in high percentages (3-5%) is detrimental to investment casting due to excessive oxidation and high melting point. Investment casting is very important in the jewelry manufacturing industry as it produces high precision finishes and provides high versatility on product design. The inability to perform investment casting will create many difficulties in the manufacturing process. Moreover, only black colored oxides have been obtained.

Similarly, Japanese patent JP2185934 disclosed gold alloys (Au—Mn—Fe, Au—Mn—Co and Au—Ag—Mn—Fe) with brown colored surfaces under heat treatment between 850° C. and 900° C. for 2 minutes. The use of manganese, iron and cobalt in high percentages (5-40% respectively) is problematic for jewelry investment casting since manganese, iron and cobalt are all very prone to oxidation.

U.S. Pat. No. 5,059,255 disclosed a gold alloy that displays a blue colored gold alloy (Au—Fe—Ni) under heat treatment between 450° ° C. and 600° ° C. for 10-12 minutes. Nickel is well-known as a culprit of skin allergy. Hence, the use of nickel is avoided in new jewelry alloy inventions.

The present invention uses gold alloys with copper and silver only, which is free from toxicants and allergens. Such alloys can be readily prepared by investment casting without the drawbacks of oxidation defects. Contrary to other inventions, the present invention can create a range of desirable coloration to the same gold alloy. This will provide diverse opportunities and benefits to the jewelry manufacturing and design industry.

It is important to stress the difference between the present invention and the prior arts of gold alloy patination. In the present invention, multiple colors across a wide spectrum can be produced by controlling the heating time, while other gold alloy patination processes can only generate one or two colors. The most significant difference is the origin of patina color. The origin of patina colors taught in prior arts is due to the formation of a metal oxide layer which is up to a few micrometers thick, and the patina color is dependent on the color of the metal oxide. In the present invention, however, the origin of patina colors is due to thin-film interference, as the thickness of patina layer is in nanometer scale.

SUMMARY OF THE INVENTION

This invention provides an alloy with an interference thin film. In one embodiment, said alloy consists essentially of 55.0-78.0 wt % Au, 8.0-24.0 wt % Ag, 8.0-24.0 wt % Cu and 0.0-3.0 wt % deoxidizer; and said interference thin film is grown on a surface of said alloy and has a thickness of less than 200 nm; wherein said interference thin film exhibits a patination color.

This invention also provides a decorative item comprising the alloy of this invention.

This invention further provides a method of preparing an alloy with an interference thin film. In one embodiment, said method comprises the steps of: (a) Providing said alloy consisting essentially of 55.0-78.0 wt % Au, 8.0-24.0 wt % Ag and 8.0-24.0 wt % Cu and 0.0-3.0 wt % deoxidizer; wherein said alloy comprises a surface for forming said interference thin film; and (b) Heating said alloy in an inert atmosphere at a temperature between 400 to 500° C. for a period of time to form said interference thin film on said surface; wherein said interference thin film has a thickness of less than 200 nm and exhibits a patination color.

DETAILED DESCRIPTION OF THE INVENTION

The following terms shall be used to describe the present invention. In the absence of a specific definition set forth herein, the terms used to describe present invention shall be given their common meaning as understood by those of ordinary skill in the art.

As used herein, the expression BSE refers to backscattered electron.

As used herein, the expression FESEM refers to field emission scanning electron microscopy.

It is an object of the present invention is to provide the methods for coloring gold alloys.

It is another object of the present invention to provide the methods of coloring gold alloys which are manufactured with conventional alloys and conventional processes, including but not limited to, investment casting.

It is another object of the present invention to provide the methods for coloring gold alloys, of which the resultant colors include, but are not limited to, orange, red, purple, blue, green, yellow etc. The patinated colors can be measured by CIELAB coordinates, which is a 3-dimensional measuring system for colors. The L* axis defines black at 0 and white at 100 to measure the lightness, the a* axis defines red at positive values and green at negative values to measure the red-green component, the b* axis defines yellow at positive values and blue at negative values to measure the yellow-blue component.

This invention provides methods to induce colouring on gold alloys. In one embodiment, said gold alloy comprises essentially 55.0 to 78.0 wt % Au; 8.0 to 24.0 wt %; and 8.0 to 24.0 wt % Cu.

In one embodiment, said gold alloy may comprise essentially of an deoxidizer that does not exceed 3.0 wt %, in replacement of Ag and Cu.

In one embodiment, said deoxidizer is selected from Zn or Si or a mixture of these.

In one embodiment, said gold alloy comprises essentially of 55.0 to 62 wt % Au; 17.0 to 24.0 wt % Ag and 17.0 to 24.0 wt % Cu.

In one embodiment, said gold alloy comprises essentially of 72.0 to 78.0 wt % Au; 8.0 to 17.0 wt % Ag; and 8.0 to 17.0 wt % Cu.

In one embodiment, said gold alloy comprises essentially of 56.8 to 59.8 wt % Au; 19.3 to 22.4 wt % Ag; and 19.3 to 22.4 wt % Cu.

In one embodiment, said gold alloy comprises essentially of 73.5 to 76.5 wt % Au; 11.0 to 14.0 wt % Ag; and 11.0 to 14.0 wt % Cu.

In one embodiment, said gold alloy comprises essentially of 58.3 wt % Au; 20.85 wt % Ag; and 20.85 wt % Cu.

In one embodiment, said gold alloy comprises essentially of 75.0 wt % Au; 12.5 wt % Ag; and 12.5 wt % Cu.

Figure 1A:
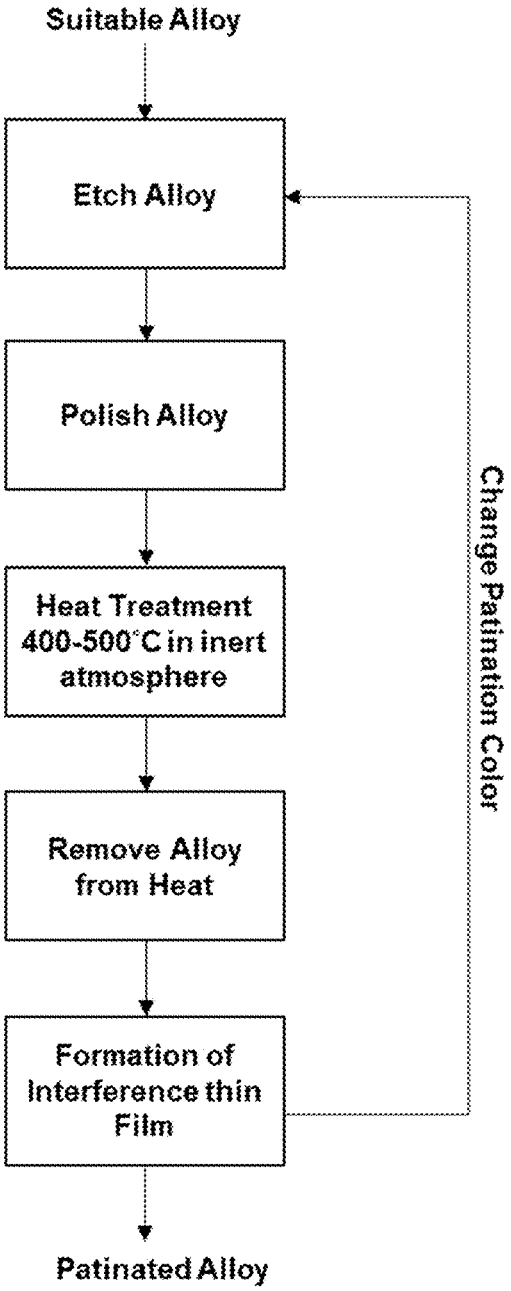
FIG. 1A is the schematic general representation of the present invention.
Figure 1B:
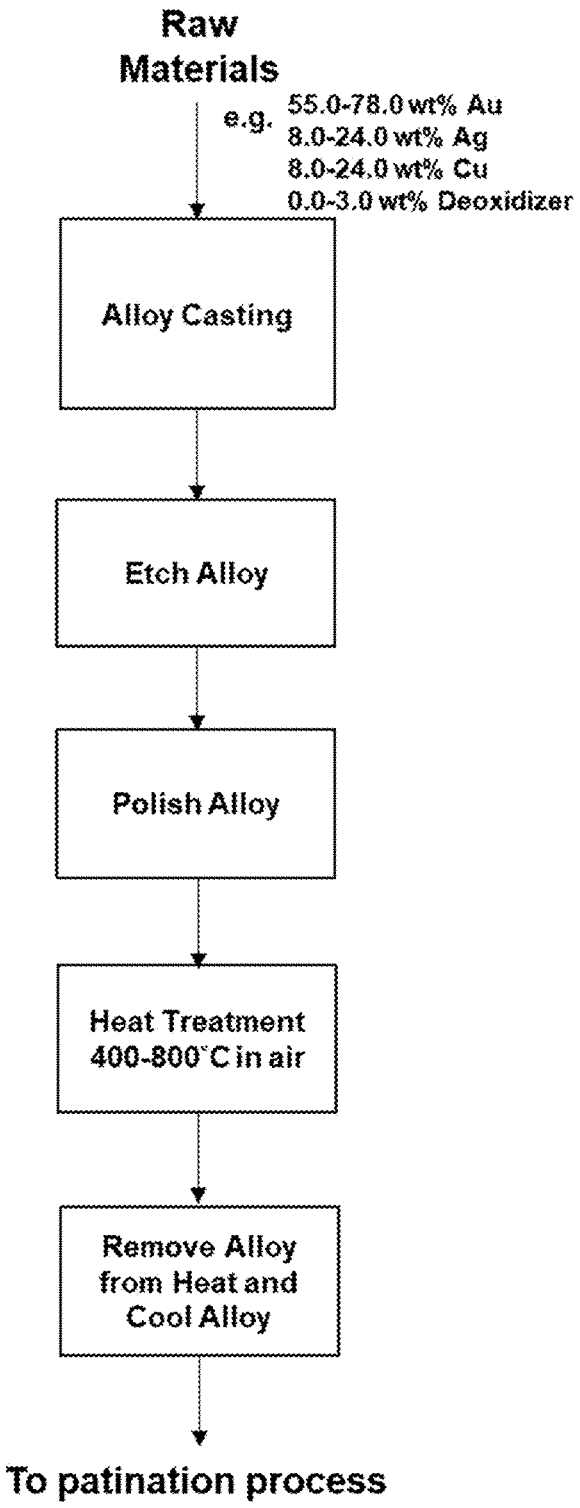
FIG. 1B is the schematic general representation of a pre-treatment in one embodiment of the present invention.

In one embodiment, the present invention provides a method of preparing alloys of gold having desired color characteristics. The schematic general representation of the method is shown in FIG. 1A. In one embodiment, the method also has a pre-treatment as shown in FIG. 1B. The method of this invention may comprise the following steps: melting gold, silver, copper and optionally selected deoxidizers, to form an alloy by pouring into a mold of desired shape; etching said alloy; polishing said alloy; heating said alloy for the first time at a temperature between 400° C. and 800° C. in air until a visually observable grey-black color occurs; cooling said alloy to ambient temperature; etching said alloy for the second time; polishing said alloy; heating said alloy for the second time at a temperature between 400° C. and 500° ° C. in an inert atmosphere; and cooling said alloy to ambient temperature under air.

In one embodiment, said alloy is prepared using conventional investment casting process.

In one embodiment, said alloy is etched using dilute acid.

In one embodiment, said dilute acid is dilute sulfuric acid or dilute hydrochloric acid.

In one embodiment, the surface of said alloy, where coloration is designated, is polished to mirror finish.

In one embodiment, the temperature of the furnace for the first heat treatment of said alloy is between 400 to 800° C. for a duration of at least 10 minutes under normal atmosphere. Normal air, for example, will suffice. Said alloy will result in a greyish-black color surface and is allowed to cool to ambient temperature.

In one embodiment, the temperature of the furnace for the second heat treatment of said alloy under an inert atmosphere is between 400° ° C. and 500° ° C. When allowed to cool to ambient temperature, the change of color of said alloy's polished surface will be observed.

In one embodiment, said inert atmosphere is argon.

In one embodiment, the patinated color of said alloy is dependent on the duration of the second heat treatment.

In one embodiment, the color difference, delta E (ΔE), before and after the second heat treatment step for forming patinated color is at least 10.0.

In one embodiment, the patinated color of said alloy includes, but is not limited to, orange, red, purple, blue, green to yellow.

In one embodiment, the patinated color is uniform across the polished surface of said alloy.

Figure 2:
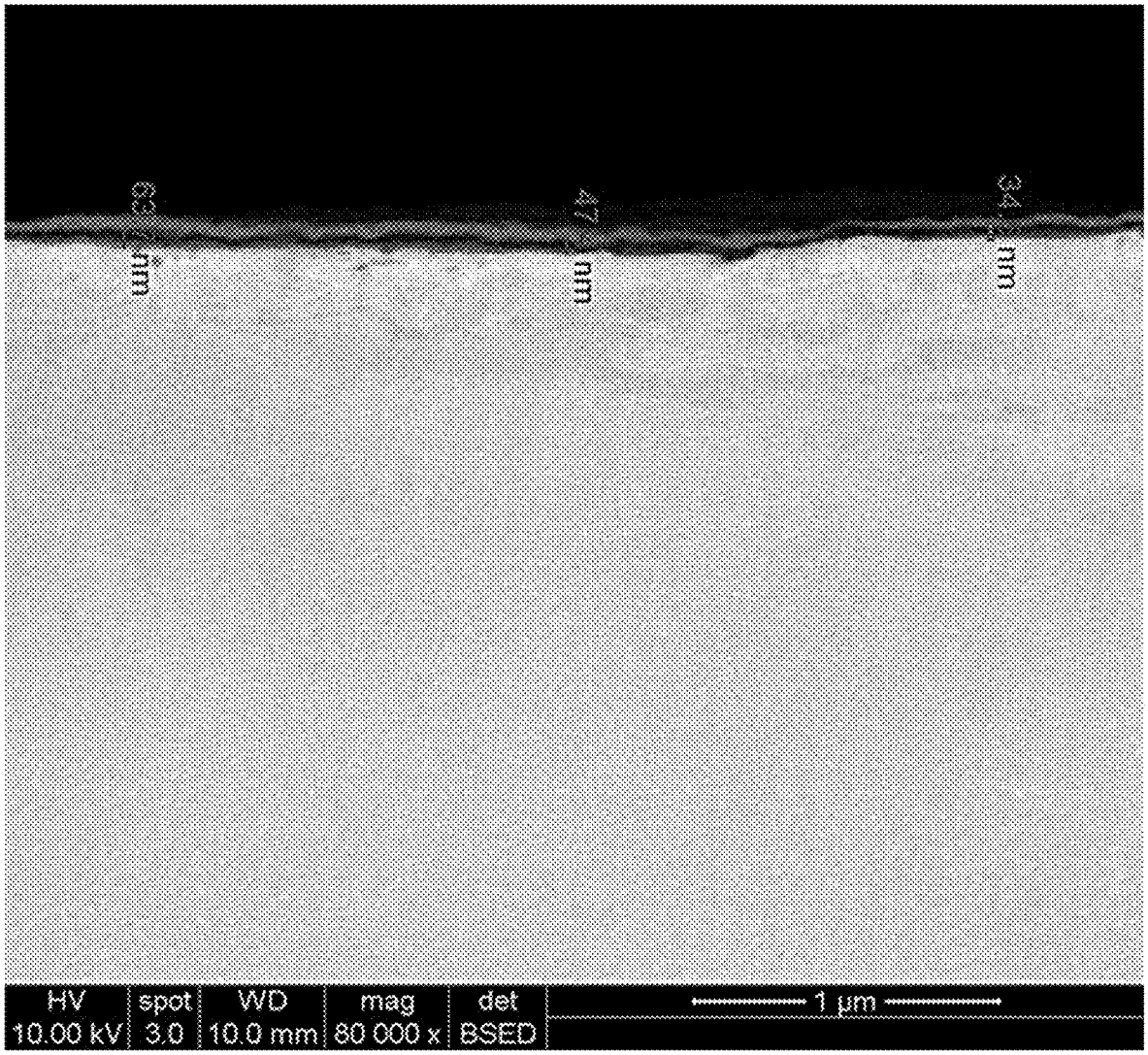
FIG. 2 is the FESEM image 80000× magnification showing the thickness of the purple-patinated color layer does not exceed 200 nm. Cross-section was polished by ion-beam milling.
Figure 3:
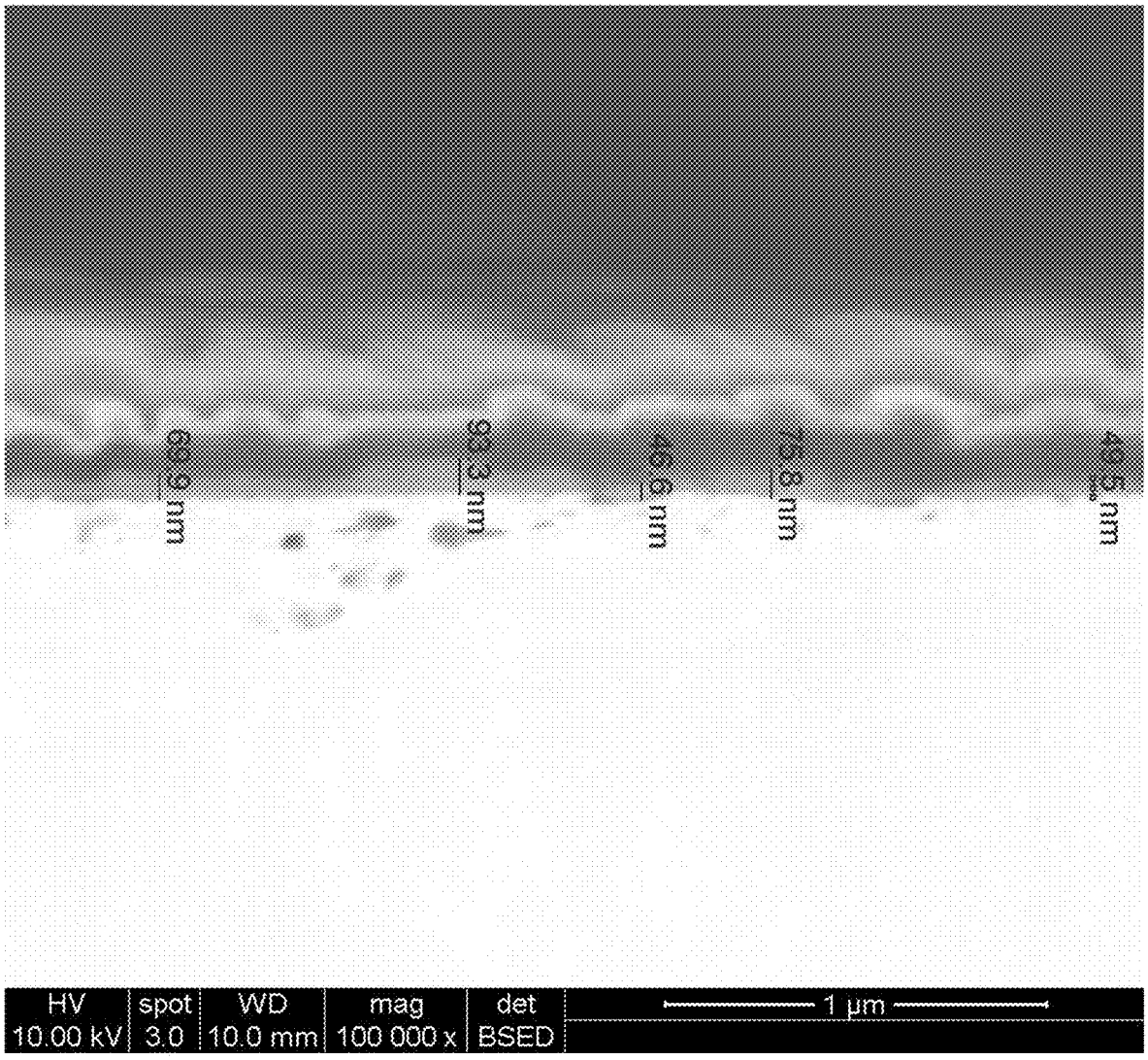
FIG. 3 is the FESEM image 100 000× magnification showing the thickness of the blue-patinated color layer does not exceed 200 nm. Cross-section was polished by ion-beam milling.

In one embodiment, the thickness of the patinated colored layer does not exceed 200 nm. FIG. 2 and FIG. 3 show typical cross-sectional BSE FESEM views of patinated gold alloys produced by an embodiment of this invention, having patinated colored layer thickness of below 200 nm.

In one embodiment, if the patination color of the same said alloy is to be altered, said alloy may be etched, polished and heat treated again under an inert atmosphere between 400° C. and 500° ° C. The duration of heat treatment may be adjusted to the correspondent color designated as previously stated for the second heat treatment.

This invention provides an alloy with an interference thin film. In one embodiment, said alloy consists essentially of 55.0-78.0 wt % Au, 8.0-24.0 wt % Ag, 8.0-24.0 wt % Cu and 0.0-3.0 wt % deoxidizer; and said interference thin film is grown on a surface of said alloy and has a thickness of less than 200 nm; wherein said interference thin film exhibits a patination color.

In one embodiment, said patination color comprises orange, red, purple, blue, green or yellow.

In one embodiment, said patination color has a color difference (ΔE) of at least 10.0 compared with said surface before patination.

In one embodiment, said alloy consists essentially of: i) 55.0 to 62 wt % Au; 17.0 to 24.0 wt % Ag and 17.0 to 24.0 wt % Cu; ii) 72.0 to 78.0 wt % Au; 8.0 to 17.0 wt % Ag; and 8.0 to 17.0 wt % Cu; iii) 56.8 to 59.8 wt % Au; 19.3 to 22.4 wt % Ag; and 19.3 to 22.4 wt % Cu; iv) 73.5 to 76.5 wt % Au; 11.0 to 14.0 wt % Ag; and 11.0 to 14.0 wt % Cu; v) 58.3 wt % Au; 20.85 wt % Ag; and 20.85 wt % Cu; or vi) 75.0 wt % Au; 12.5 wt % Ag; and 12.5 wt % Cu.

In one embodiment, said deoxidizer comprises one or more of zinc or silicon.

In one embodiment, said alloy is formed by investment casting.

This invention also provides a decorative item comprising the alloy of this invention.

In one embodiment, said decorative item is a jewelry.

This invention further provides a method of preparing an alloy with an interference thin film. In one embodiment, said method comprises the steps of: (a) Providing said alloy consisting essentially of 55.0-78.0 wt % Au, 8.0-24.0 wt % Ag and 8.0-24.0 wt % Cu and 0.0-3.0 wt % deoxidizer; wherein said alloy comprises a surface for forming said interference thin film; and (b) Heating said alloy in an inert atmosphere at a temperature between 400 to 500° C. for a period of time to form said interference thin film on surface of said alloy; wherein said interference thin film has a thickness of less than 200 nm and exhibits a patination color.

In one embodiment, said method further comprises subjecting said alloy of step (a) to pre-treatment on said surface prior to step (b).

In one embodiment, said pre-treatment comprises the steps of: (i) heating said alloy at 400 to 800° C. in air; and (ii) etching and polishing said surface.

In one embodiment, step (i) comprises heating said alloy for at least 10 minutes or until a grey-black or black coloration is observed.

In one embodiment, said patination color is orange, red, purple, blue, green or yellow.

In one embodiment, said interference thin film has a color difference (ΔE) of at least 10.0 compared with said surface before patination.

In one embodiment, said inert atmosphere is argon.

In one embodiment, said method further comprises forming said alloy of step (a) by investment casting prior to step (b).

In one embodiment, said method further comprises repeating step (b) to alter said patination color until a desired color is achieved.

In one embodiment, said method further comprises subjecting said alloy to etching and polishing said surface prior to repeating step (b).

In one embodiment, said period of time is controlled based on one or more of the parameters comprising size of said surface, size of said alloy, or said temperature of step (b).

In one embodiment, said period of time is controlled to be less when the temperature of step (b) is higher.

The invention will be better understood by reference to the following examples, but those skilled in the art will readily appreciate that the specific examples detailed are only illustrative, and are not meant to limit the invention as described herein, which is defined by the claims which follow thereafter.

Throughout this application, various references or publications are cited. Disclosures of these references or publications in their entireties are hereby incorporated by reference into this application in order to more fully describe the state of the art to which this invention pertains. It is to be noted that the transitional term "comprising", which is synonymous with "including", "containing" or "characterized by", is inclusive or open-ended and does not exclude additional, un-recited elements or method steps.

Example 1

A 6 g gold alloy ring with composition 75.0 wt % Au, 12.5 wt % Ag, 12.5 wt % Cu was prepared following the method of the present invention. The alloy was casted, etched with dilute sulfuric acid and polished. The grey-black coloration of oxidized alloy was visible after the first heat treatment at 500° C. for 15 minutes in air. The CIELAB coordinates of the alloy at this stage are as follows: L*42.61, a*−0.35 and b*−1.58. The alloy was etched with dilute sulfuric acid and polished again. The CIELAB coordinates of the alloy's polished surface was measured (trial 1) and shown below in Table 1. The alloy was heat treated for the second time at 450° ° C. under argon for 2 minutes and cooled to room temperature in air. The polished surface of alloy displayed a red color patination as shown from CIELAB measurements below (trial 2).

The alloy was etched, polished, and heat treated at 450° C. under argon again for four times for different durations. It can be seen that different heating duration results in different patination color on the same alloy (trials 3 to 6).

Trials 7 to 9 were produced for comparative purpose on alloys with composition of 75.0 wt % Au, 12.5 wt % Ag and 12.5 wt % Cu. The heat treatment conditions and CIELAB measurements of the resultant alloy surfaces are shown in table 1 respectively. The comparison of CIELAB results of trials 7, 8 and 5 shows that the first heat treatment step of 500° C. for 15 minutes in air was necessary to achieve desirable patination colors. The comparison of CIELAB results of trials 9 and 5 shows an inert atmosphere must be kept in the second heat treatment step at 450° ° C. for 5 minutes to achieve a bright and appealing color on the alloy.

TABLE 1

Experimental Results

| | Heat Treatment Time (min) | | CIELAB (Measured) | | | | |
|---|---|---|---|---|---|---|---|
| | 1st heating | 2nd heating | | | | | |
| Trial | 500° C. (air) | 450° C. | L* | a* | b* | ΔE | Color |
| 1 | 15 | 0 | 85.20 | 5.50 | 21.91 | — | Pale Yellow |
| 2 (inv.) | 15 | 2 (in argon) | 55.26 | 27.84 | 28.83 | 37.99 | Red |
| 3 (inv.) | 15 | 3 (in argon) | 52.30 | 22.42 | 6.92 | 39.92 | Purple |
| 4 (inv.) | 15 | 4 (in argon) | 52.60 | −12.65 | −7.09 | 47.26 | Blue |
| 5 (inv.) | 15 | 5 (in argon) | 71.05 | −15.32 | 11.32 | 27.31 | Bright blue-green |
| 6 (inv.) | 15 | 6 (in argon) | 67.27 | 5.69 | 42.10 | 27.00 | Bright Yellow |
| 7 (comp.) | — | 5 (in argon) | 67.11 | 10.15 | 24.31 | — | Pale Brown |
| 8 (comp.) | — | 5 (in air) | 55.63 | 8.18 | 6.33 | — | Grey |
| 9 (comp.) | 15 | 5 (in air) | 60.97 | 13.23 | 14.40 | — | Brown |

Example 2

Two 6 g gold alloys were prepared with compositions listed in Table 2 following the method of the present invention for comparative purpose. The alloys were casted, etched with dilute sulfuric acid and polished. The CIELAB coordinates of after the first heat treatment step of 500° C. for 15 minutes in air for trials 10 and 11 were L*49.91, a*−0.44, b*0.76 and L*57.10, a*−2.08, b* 5.60 respectively. The alloys were etched with dilute sulfuric acid and polished before the second heat treatment was conducted. The CIELAB coordinates of before and after the second heat treatment step of 450° ° C. for 5 minutes under argon were listed in Table 2. The resultant patination color of Trial 10 was brown and was not desirable. Delta E (ΔE) is a measurement that quantifies the difference between two colors, where any values below 2 are hardly detectable by the human eye. The ΔE of the measured CIELAB results before and after the second heat treatment for trial 11 was only 1.54, which suggests that a desirable patination color was not formed. The comparison of CIELAB results of trials 5 (Table 1), 10 and 11 (Table 2) showed that composition deviation from the specified embodiment in the present invention will lead not lead to desirable patination colors.

TABLE 2

| Experimental Results | | | | | | | | | | |
|---|---|---|---|---|---|---|---|---|---|---|
| | | | | CIELAB (Measured) | | | | | | |
| | Composition (%) | | | Before $2^{nd}$ heating | | | $2^{nd}$ heating 450° C., 5 min (argon) | | | |
| | Au | Ag | Cu | L* | a* | b* | L* | a* | b* | Color |
| 10 (comp.) | 75 | 1 | 24 | 78.03 | 8.85 | 15.93 | 51.80 | 12.40 | 16.24 | Brown |
| 11 (comp.) | 75 | 24 | 1 | 75.50 | 1.43 | 26.36 | 73.76 | 4.28 | 35.71 | Dull Yellow |

What is claimed is:

1. An alloy with an interference thin film, wherein:

i. said alloy consists essentially of 55.0-78.0 wt % Au, 8.0-24.0 wt % Ag, 8.0-24.0 wt % Cu and 0.0-3.0 wt % deoxidizer;

ii. said interference thin film is grown directly from within said alloy onto a surface of said alloy and has a thickness of less than 200 nm;

wherein said interference thin film exhibits a desired patination color.

2. The alloy of claim 1, wherein said desired patination color comprises orange, red, purple, blue, green or yellow.

3. The alloy of claim 1, wherein said desired patination color has a color difference (ΔE) of at least 10.0 compared with said surface before patination.

4. The alloy of claim 1, wherein said alloy consists essentially of:

i. 55.0 to 62 wt % Au; 17.0 to 24.0 wt % Ag and 17.0 to 24.0 wt % Cu;

ii. 72.0 to 78.0 wt % Au; 8.0 to 17.0 wt % Ag; and 8.0 to 17.0 wt % Cu;

iii. 56.8 to 59.8 wt % Au; 19.3 to 22.4 wt % Ag; and 19.3 to 22.4 wt % Cu;

iv. 73.5 to 76.5 wt % Au; 11.0 to 14.0 wt % Ag; and 11.0 to 14.0 wt % Cu;

v. 58.3 wt % Au; 20.85 wt % Ag; and 20.85 wt % Cu; or vi. 75.0 wt % Au; 12.5 wt % Ag; and 12.5 wt % Cu.

5. The alloy of claim 1, wherein said deoxidizer comprises one or more of zinc or silicon.

6. The alloy of claim 1, wherein said alloy is formed by investment casting.

7. A decorative item comprising the alloy of claim 1.

8. The decorative item of claim 7, wherein said decorative item is a jewelry.

9. A method of preparing an alloy with an interference thin film, comprising the steps of: comprising the steps of:

a. providing said alloy consisting essentially of 55.0-78.0 wt% Au, 8.0-24.0 wt% Ag and 8.0-24.0 wt% Cu and 0.0-3.0 wt% deoxidizer; wherein said alloy comprises a surface for forming said interference thin film; and b. heating said alloy in an inert atmosphere at a temperature between 400° C. to 500° C. for a period of time to grow said interference thin film directly from within said alloy onto said surface; wherein said interference thin film has a thickness of less than 200nm and exhibits a desired patination color.

10. The method of claim 9, further comprising subjecting said alloy of step (a) to pre-treatment on said surface prior to step (b).

11. The method of claim 10, wherein said pre-treatment comprises the steps of:

i. heating said alloy at 400° C. to 800° C. in air; and ii. etching and polishing said surface.

12. The method of claim 11, wherein said step (i) comprises heating said alloy is heated for at least 10 minutes or until grey-black or black coloration is observed.

13. The method of claim 9, wherein said interference thin film is orange, red, purple, blue, green or yellow in color.

14. The method of claim 9, wherein said interference thin film has a color difference (ΔE) of at least 10.0 compared with said surface before patination.

15. The method of claim 9, wherein said inert atmosphere is argon.

16. The method of claim 9, further comprises forming said alloy of step (a) by investment casting prior to step (b).

17. The method of claim 9, further comprises repeating step (b) to alter said desired patination color until a desired color is achieved.

18. The method of claim 17, further comprising subjecting said alloy to etching and polishing said surface prior to repeating step (b).

19. The method of claim 9, wherein said period of time is controlled based on one or more of the parameters comprising size of said surface, size of said alloy, or said temperature of step (b).

20. The method of claim 19, wherein said period of time is controlled to be less when the temperature of step (b) is higher.

* * * * *